US005302881A

United States Patent [19]

O'Loughlin

[11] Patent Number: 5,302,881

[45] Date of Patent: Apr. 12, 1994

[54] HIGH ENERGY CATHODE DEVICE WITH ELONGATED OPERATING CYCLE TIME

[75] Inventor: James P. O'Loughlin, Albuquerque, N. Mex.

[73] Assignee: The United States of America as represented by the Secretary of the Air Force, Washington, D.C.

[21] Appl. No.: 896,064

[22] Filed: Jun. 8, 1992

[51] Int. Cl.[5] ..... H01J 7/24

[52] U.S. Cl. ..... 315/111.21; 315/39.63; 315/3.5; 315/326; 313/363.1; 313/346 R

[58] Field of Search ..... 315/111.21, 3.5, 39.63, 315/326; 313/363.1, 346 R

[56] References Cited

U.S. PATENT DOCUMENTS

| | | | |
|---|---|---|---|
| 3,896,332 | 7/1975 | Heathcote | 315/39.63 |
| 4,297,615 | 10/1981 | Goebel et al. | 315/111.21 |
| 4,467,205 | 8/1984 | Beisswenger et al. | 313/363.1 |
| 4,634,935 | 1/1987 | Hillenbrand et al. | 315/169.4 |
| 4,659,963 | 4/1987 | Huber | 313/493 |
| 4,749,911 | 6/1988 | Wakalopulos et al. | 315/111.21 |

*Primary Examiner*—Robert J. Pascal
*Assistant Examiner*—Haissa Philogene
*Attorney, Agent, or Firm*—Gerald B. Hollins; Thomas L. Kundert

[57] ABSTRACT

A high energy level electronic device is segregated into source diode and utilization diode portions, portions which may also be identified as cathode and main diode portions, respectively. The cathode diode portion is operated at a low voltage such that closure velocity effects therein although present, are minimized. A current of electrons, generated by in cathode diode plasma is fed to the second diode through an anode screen portion of the cathode diode. In this arrangement, since there are electrons, but no plasma cathode present in the main diode, no closing problem occurs therein. In this arrangement, therefore the cathode diode is effectively a source of current for the main diode and is operated at minimal voltage to enable the provision of current for a maximum length of time prior to closure effect terminations. The main diode is separated from the plasma and therefore may be operated at any arbitrarily high voltage free from closing effects, which remain isolated and controlled in the cathode diode. Separate pulse forming network energization of the cathode and main diode portions of the device are also disclosed.

19 Claims, 3 Drawing Sheets

HIGH ENERGY CATHODE DEVICE WITH ELONGATED OPERATING CYCLE TIME

RIGHTS OF THE GOVERNMENT

The invention described herein may be manufactured and used by or for the Government of the United States for all governmental purposes without the payment of any royalty.

BACKGROUND OF THE INVENTION

This invention relates to the field of charged particle generation for high energy electronic apparatus.

Pulsed electron beam devices which operate at high power levels and high voltages (powers in the gigawatts and voltages above 100 kilovolts, for example), need electron sourcing cathodes capable of operating at high current densities (densities of 100 amperes per square centimeter and higher, for example), in order to be feasible. An inexpensive and simple cathode which is capable of operating in this environment employs materials such as graphite, carbonized felt, or other substances having the property that when suitably excited there results a high temperature plasma of positive and negative charges which can serve briefly as a source of electrons and therefore be considered to be a plasma cathode. Enhancing the operating cycle time of such a plasma cathode is a principal concern of the present invention.

The generation of a surface plasma in this manner occurs through enhancement of the electric field intensity occurring at a large number of small projections or irregularities found on the surface of the cathode material. Such electric field enhancement can accomplish the field emission of electrons. This emission can be forced to high current densities by a suitable applied voltage, a voltage which tends to thermally heat the cathode surface projections to explosively high temperatures and thereby form a plasma of positive and negative charged particles.

The explosive formation of such a plasma is accompanied by imparting a movement velocity normal to the cathode surface to the plasma. This movement velocity typically ranges from about five kilometers per second at an accelerating potential of 150 kilovolts to velocities of 20 to 30 kilometers per second with accelerating potentials of several hundred kilovolts.

This plasma surface motion is in effect a current flowing through an evacuated structure which contains the cathode and anode elements. The nature of this current is defined by the Child-Langmuir equation which may be expressed as:

$$J=2.34E-6\ V^{3/2}/d^2 \qquad (1)$$

where

J=current density (A/sq meter)

V=cathode to anode voltage (volts)

d=cathode to anode spacing (meters)

In using the Child-Langmuir equation the effective cathode to anode spacing, d, is the distance measured between the moving plasma surface and the anode electrode. Since the plasma is in motion, however, this spacing distance d changes with time. As the spacing d decreases, for example, the current density for the same cathode to anode voltage can be observed to increase according to the Child-Langmuir relationship. Such current change as a result of spacing decrease can be counterproductive, and may be accommodated or compensated in a particular electron device by varying the cathode to anode voltage. However, such change influences the operating power level and may also produce other changes in the operating characteristics of the device. For example, if the operating device is a virtual cathode oscillator, a VICATOR, the oscillating frequency is determined by this voltage and to an even greater extent by the cathode to anode spacing and therefore can be predicted to vary with changes in either of these parameters.

In practice, the changing of cathode to anode spacing in a plasma-dependent electronic device is referred to as "closing" of the cathode. Ultimately the plasma cathode reaches the anode and thereby closes the cathode to anode space to a final value of zero. Typically, this closing action also has the undesirable effect of limiting the usable operating time of an electronic device employing the plasma cathode to times in the 100 to 150 nanoseconds range. The overcoming of this operating time limitation is a principle feature of the present invention.

The patent art shows examples of electron apparatus of this general nature. Included in this patent art is the U.S. Patent of D. M. Goebel et al, U.S. Pat. No. 4,297,615, which is concerned with a high current density thermionic cathode structure wherein heat is used to obtain a high density plasma from a lanthanum hexaboride cathode structure. The Goebel et al lanthanum hexaboride cathode element is mounted in a plasma generating chamber and is coupled to a lower plasma density utilization chamber through one or more openings or apertures which are suitably restricted, in order to maintain the plasma density in the cathode chamber above a critical level for obtaining the desired current density from the lanthanum hexaboride material. The present invention is distinguished by the filamentary heating, the lanthanum hexaboride, the high plasma density cathode chamber and the supplying of a gas stream in order to move the plasma in the Goebel et al apparatus.

Also included in this art is the patent of Bernhard Hillenbrand et al, U.S. Pat. No. 4,634,935, and the patent of Wilhelm Huber, U.S. Pat. No. 4,659,963. Both the Hillenbrand et al and Huber patents are concerned with gas discharge display devices wherein a vacuum-tight enclosure is divided into separate spaces and wherein charged particle plasmas are used as a source of electrons for operating the display. The present invention is distinguished from the low operating power levels and other features in the Hillenbrand and Huber patents.

This art also includes the patent of George Wakalopulos et al, U.S. Pat. No. 4,749,911, which is concerned with an ion plasma electron gun housing dose rate control that is achieved by way of amplitude modulation of a plasma discharge. In the Wakalopulos invention, positive ions generated by a wire in a plasma discharge chamber are accelerated through an extraction grid into a second chamber containing a high voltage cold cathode. These positive ions bombard a surface of the cathode, causing the cathode to emit secondary electrons which form an electron beam. The present invention is distinguished over the Wakalopulos electron gun by structural and functional differences which include the secondary electron emission mechanism.

SUMMARY OF THE INVENTION

The present invention provides a high energy electron source that extends by several fold the operating cycle timewise limitation resulting from cathode closure effects. This improvement is achieved by segregating the plasma sourced generation of electrons from the electron usage portion in an electronic device and operating the closure effect susceptible plasma inclusive portion of the device at a relatively low voltage. Electrons extracted from the thus-formed plasma are communicated into a second enclosure portion of the device for utilization at higher voltages.

It is an object of the present invention therefore, to provide a high current density source of electrons that is free from the effects of cathode closure time limitations.

It is another object of the invention to provide a plasma based source of electrons that is free of closure effect time limitations.

It is another object of the invention to provide a plasma based source of high density electrons usable over an operating period of tenths to tens of microseconds.

It is another object of the invention to provide a high density source of electrons based on the field emission generation of charged particle plasma.

It is another object of the invention to provide a high density source of electrons which originates in a separate plasma chamber.

It is another object of the invention to provide a separate plasma chamber electron source which is operable at conditions favoring a long operating cycle time.

It is another object of the invention to provide a high current density source of electrons which is immune to operating conditions in a utilization chamber portion of the apparatus.

It is another object of the invention to provide a method for operating a plasma source chamber and electron utilization chamber which are in electron communication with each other.

It is another object of the invention to provide a method for achieving increased operating cycle time in a plasma sourced electron apparatus.

It is another object of the invention to provide a method for generating a quantity of electrons that is minimally influenced by electron utilization operating potentials.

It is another object of the invention to provide a plasma based source of high current density electrons wherein segregation of plasma ions and plasma electrons occurs with the aid of an electrically charged screen member.

It is another object of the invention to provide a method for operating a dual anode electron generating and electron utilizing apparatus.

It is another object of the invention to provide an energization arrangement for a dual anode electron generating and utilizing apparatus.

It is another object of the invention to provide a pulsed energy source arrangement for a dual voltage, dual chamber electron sourcing and electron utilizing apparatus.

Additional objects and features of the invention will be understood from the following description and claims and from the accompanying drawings.

These and other objects of the invention are achieved by a high current pulsed beam apparatus of tenths to tens of microseconds operating cycle duration comprising the combination of:

means including an emissive material surfaced first electrode member and electric field generating means therefor for generating a plasma of positive and negative charges in a closing velocity responsive first chamber portion of an evacuated enclosure in the apparatus;

a selected charge transparent second electrode member disposed opposite the first electrode member in the evacuated enclosure first chamber portion;

a charge collecting third electrode member disposed opposite the second electrode member in a selected change operated and closing velocity immune second chamber portion of the evacuated enclosure;

the selected charge transparent second electrode member being disposed intermediate the first and second chamber portions of the evacuated enclosure and enabling communication of vacuum and the selected charges therethrough.

DETAILED DESCRIPTION

Figure 1:
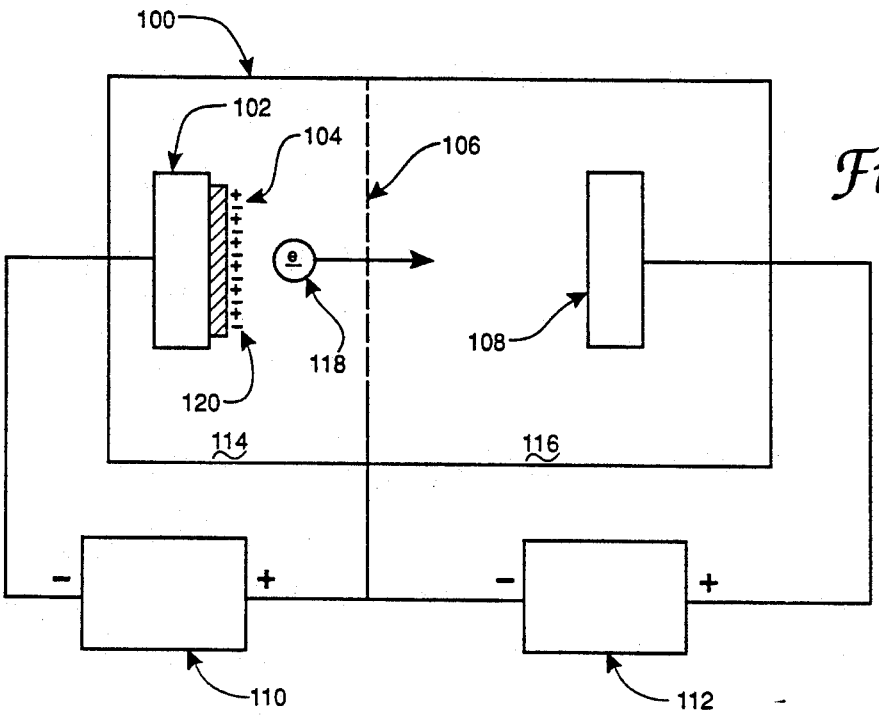
FIG. 1 shows a pictorial and schematic diagram of the invention.

A functional arrangement of the invention is shown in diagram form in FIG. 1 of the drawings. The FIG. 1 illustrated elements consist of a vacuum enclosure 100 which is capable of sustaining a pressure of typically less than 0.0001 Torr or 0.0001 millimeters of mercury. Within the vacuum enclosure 100 are three electrically isolated elements including the electrode 102 which includes an emitting surface 104. The emitting surface 104 is comprised of material such as carbon felt, graphite, carbonized textile cloth, impregnated metallic sponge or a similar material commonly used in the art for the purpose of generating an explosive plasma when excited by high electric field stresses.

A screen electrode 106 housing a high ratio of open area to screen structure, a ratio of typically 80% or more, serves as the anode electrode of a left hand portion 114 of the FIG. 1 apparatus. This left hand portion of the FIG. 1 apparatus is also referred to as the electron source or cathode diode portion of the FIG. 1 apparatus. The source 114 in FIG. 1 is therefore comprised of the pair of electrodes consisting of a cathode 102, including the emitting surface 104, and the screen anode 106.

A second portion, the use diode or electron utilization or main diode portion 116 of the FIG. 1 apparatus, consists of the screen electrode 106, which is the cathode of this main diode, and a second anode electrode 108, which is therefore the anode of the main diode. The anode electrode 108 may be fabricated of any electrically conductive material commonly used for electrodes, such as a metal.

Two pulsed electrical energy sources are connected to the FIG. 1 apparatus: the cathode diode pulsed source 110 and the main diode pulsed source 112. The negative terminal of the cathode diode pulsed source 110 is connected to the cathode electrode 102 and the positive terminal of this source is connected to the screen electrode 106. The negative terminal of the main diode pulsed source 112 is connected to the screen electrode 106 and the positive terminal to the anode electrode 108.

The invention employs the two diodes 114 and 116 for the purpose of isolating and confining the above described closing phenomenon to one of the diodes, the cathode diode, in order that the other diode, the main diode, operate free from the deleterious effects of the closing phenomenon. The source of the electrons, 118 in the FIG. 1 apparatus, is the plasma 120 of positive and negative charged particles. The plasma 120 is comprised of the positively charged ions and negatively charged electrons which form on the surface 104 of electrode 102 when a high intensity electric field is applied by means of the cathode diode pulsed source 110 and the screen 106. The electrons which are represented at 118 leave the plasma 120 under the influence of this high intensity electric field from the cathode diode pulsed source 110 and are attracted to the screen electrode 106. Only a single electron 118 is shown in the FIG. 1 diagram, however, this single electron represents a continuance stream or current of electrons being emitted from the plasma area on the surface 104.

This plasma 120 is conductive and is actually also imparted a motion toward the screen electrode 106. In this motion, the electrons are lighter and negatively charged so as to be attracted to the anode electrode 106, and arrive at this anode first-in-time with respect to the positively charged and heavier ions. It is significant to note that movement of the plasma 120 under the influence of the anode electrode 106 causes the effective spacing between the cathode and anode of the cathode diode to decrease as the plasma 120 moves toward the screen electrode 106. The result of this change in spacing changes the electrical characteristics of the cathode diode as explained previously and as determined by equation 100.

The vast majority of the electrons 118 however, pass through the screen electrode 106 because of the high percentage of openness of the screen structure. Therefore this majority of the electrons 118 traverse the "transparent" screen 106 to enter the main diode region 116. Since the plasma 120 is confined to the cathode diode 114, the effective spacing between the screen 106 and the anode 108 in the main diode 116 remains constant. Thus, there are no closing effects present in the main diode 116. This diode may therefore be used to enable increase of the electron voltage to any arbitrarily high value during the course of extracting useful energy or signals from the main diode portion 116 of the FIG. 1 apparatus without incurring any of the undesirable cathode closing effects.

The two diodes, i.e., the cathode diode 114 and main diode 116, are therefore driven from the separate pulse sources 110 and 112. The cathode diode 114 is driven at a lower voltage (on the order of one hundred fifty kilovolts, for example), such that the closing velocity of the plasma in the diode 114 is relatively low (on the order of 5 kilometers per second, for example). The fact that the closing velocity is low in the cathode diode 114 enables it to operate for a longer period of time than has heretofore been possible. Operating periods as long as several microseconds, for example, are possible. Actually, operating times ranging between tenths and tens of microseconds are to be expected from the diode 110 before other phenomenon such as high voltage arcing or breakdown limit its operating cycle.

The pulse voltage waveform applied to the cathode diode, may be adjusted such that the diode current is constant with time over the duration of the pulse. This requires that the pulse voltage decrease with time to balance the decrease in effective cathode to anode spacing in the cathode diode 114, as is characterized by equation (1).

The anode of the cathode diode 114 consists of the conductive screen 106. The screen 106 however, has high transparency such that electrons may pass through the screen apertures and into the load diode 116 with only a few percent of depletion or attenuation. This arrangement results in the load diode 116 being supplied by a current source or electron source which is the cathode diode 114. In effect, the total cathode diode serves as the cathode of the main diode by feeding it with current. The cathode diode 114 may be driven to provide various current waveforms to the main diode, however, a constant current is the most common requirement. The behavior of the main diode 116 is determined by the voltage or energy of the electrons provided by the cathode diode 114, the current provided by the cathode diode, and the cathode to anode voltage applied to the main diode 116. The expected current density relationship in the two diodes is predicted by equation (2)

$$J_m = 2.34E-6\,(V_c - V_m)^{3/2}/d_m^2 \qquad (2)$$

where:

$J_m$ = current density in the main diode, 116 in Amperes/square meter $V_m$ = main diode voltage, in volts $V_c$ = cathode diode voltage, in volts $d_m$ = distance between the screen and the anode of the main diode in meters.

The current density predicted by equation (2) applies only when the current density prediction is less than or equal to the current density provided by the cathode diode 114. Within this constraint, the operating voltage of the main diode may be chosen to have any desired waveform. Typically, the main diode 116 is operated under constant voltage conditions and the cathode diode 114 is operated under constant current conditions over the pulse duration of interest. Under these conditions, the main diode 116 current will be determined by equation (2), but limited to a maximum value equal to the cathode diode current.

The diode closure effect is not observed in the main diode 116 since this diode does not receive the plasma 120, but is visited only by the electrons 118. The electrons 118 may form a space charge in the main diode 116, however, such a charge does not in fact incur the diode closure effect. The current in the main diode is therefore determined by equation (2) and is limited to a maximum value determined by the cathode diode 114 current without change in the effective spacing between the screen 106 and the main diode anode 116.

EXAMPLE 1

The following embodiment of the invention demonstrates use of a plasma cathode in an electrical diode 228 which operates for a one microsecond pulse period. Use of the invention in this arrangement eliminates the effects of explosive plasma cathode closure during the one microsecond useful operating pulse period. A comparison is made between an electrical diode employing the invention and a similar electrical diode using a conventional explosive plasma cathode.

The specifications of the electrical diode are given in Table 1.

TABLE 1

| | |
|---|---|
| cathode area | 0.1 sq meters, .357 meters diameter |
| cathode-anode spacing | 0.05 meters |
| closing | no closing effects for one microsecond |
| cathode-anode voltage | 500 kV |

Figure 2:
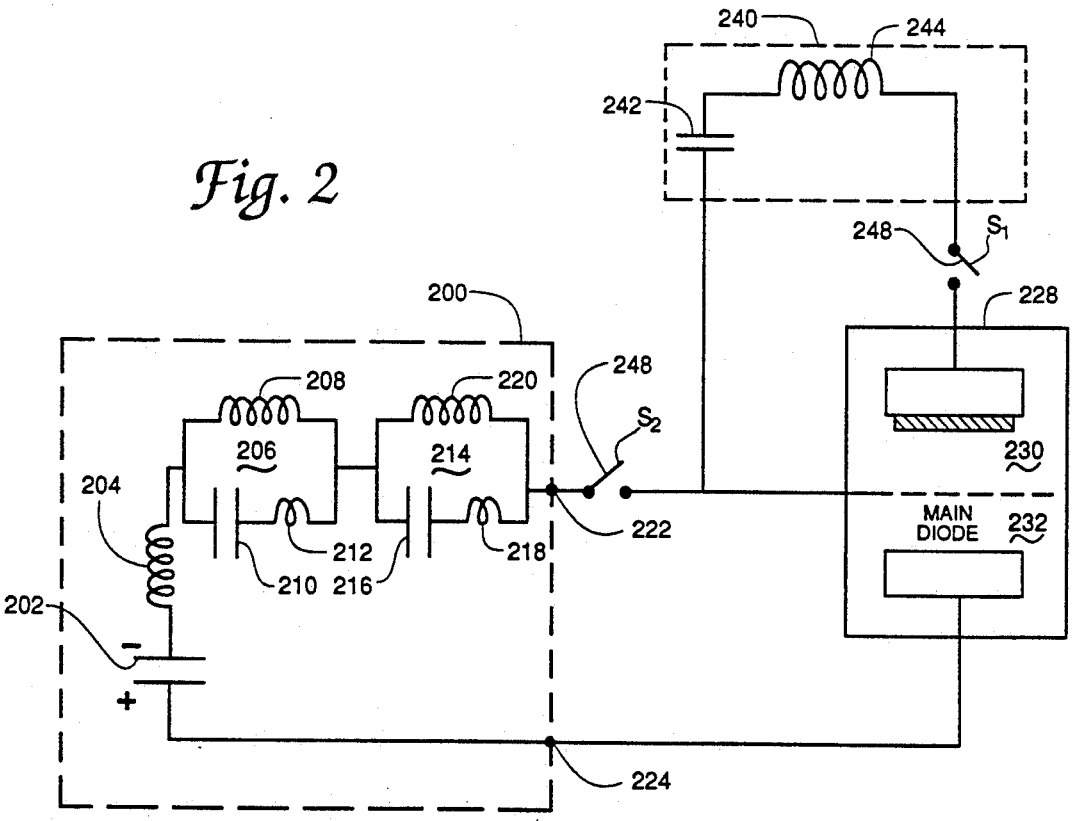
FIG. 2 shows additional details including the preferred energization arrangement for the invention.

The pulse source for the Table 1 electrical diode is a two section type A pulse forming network (PFN), according to the Guilliman terminology (as defined in the Massachusetts Institute of Technology Radiation Laboratory Series, Volume 5, Chapter 6), and is shown schematically in FIG. 2. The FIG. 2 circuit in fact shows two pulse forming networks 200 and 240 which may be used to energize the main diode portion 232 and the cathode diode portion 230 of the electrical diode 228. The network 240 delivers electrical energy to the cathode diode through the switch S1. The network 200 in FIG. 2 is of the type used in radar transmitters and delivers energy initially stored in the large capacitor 202 in the form of a pulse to the terminals 222 and 224 through and by means of the switch, S2. This pulse is of course, made to be of similar duration as the plasma cathode pulse of the present invention.

The nature of the pulse delivered to the terminals 222 and 224 is determined by the initial voltage and size of the capacitor 202 in combination with the size and nature of the series inductance 204 and the parallel L and C combinations of the branches 206 and 214. Such pulse waveform determinations are known in the art and may be more completely understood from the above-cited publication and other well-known references.

For completeness of disclosure, the components shown in FIG. 2 may use the values shown in the following Table 2.

| Component | Value |
|---|---|
| Capacitor 202 | 40 microfarads at 1000 kilovolts |
| Inductor 204 | 1.75 microhenry |
| Inductor 208 | 1.25 microhenry |
| Capacitor 210 | 16 microfarads |
| Inductor 212 | 250 nanohenries |
| Capacitor 216 | 20 microfarads |
| Inductor 218 | 100 nanohenries |
| Inductor 220 | 225 nanohenries |
| Capacitor 242 | 200 microfarads at 150 kilovolts |
| Inductor 244 | 2.0 microhenries |

Figure 3:
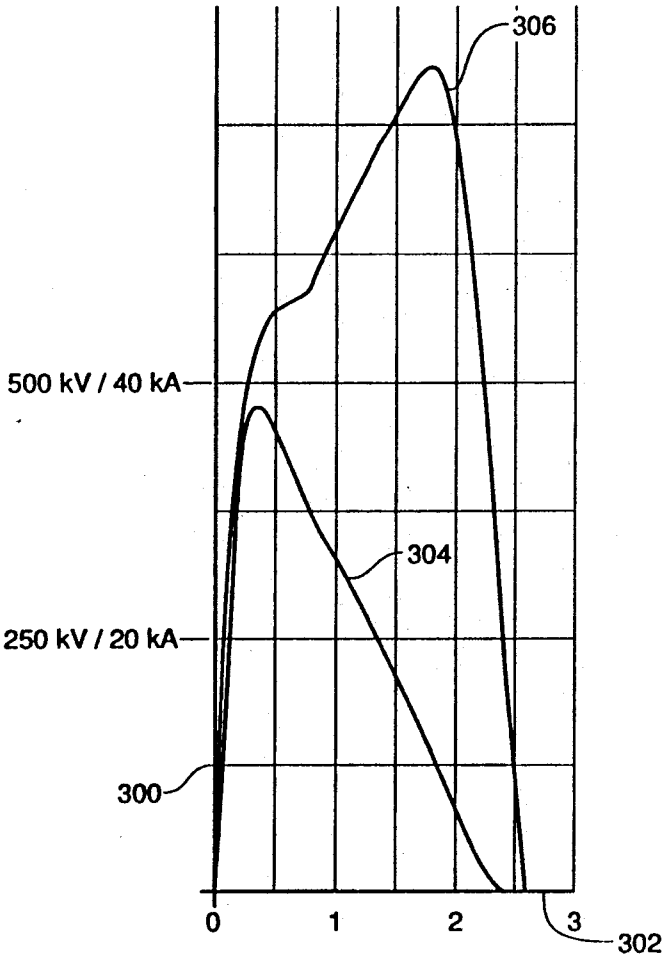
FIG. 3 shows current and voltage waveforms characteristic of a plasma source diode portion of the invention.

FIG. 3 shows the electrical performance of an electrical diode having the same dimensions as in Table 1 except that a conventional explosive plasma cathode is used therein and the present invention is not employed. The FIG. 3 electrical diode is also energized by the source 200 of FIG. 2. A plasma closing velocity of 25 kilometers per second is used to determine the performance shown in FIG. 3. The FIG. 3 diode closes by 50% of the 0.05 meter initial cathode to anode spacing in one microsecond. Due to this closure, the current waveform 306 shows a pronounced ramping up with time and the voltage waveform 304 shows a severe drop off.

To embody the FIG. 3 example in accordance with Table 1 and the present invention, a cathode diode and main diode are required. The main diode used has the same size and spacing as in Table 1 and the cathode electrode of the main diode is now of course, the anode screen of the cathode diode. The cathode diode is of the same diameter as the main diode (0.357 m), but the cathode to anode (screen) spacing is selected as 0.0136 meters. The pulse power source therefore consists of two sections, one to drive each of the two diodes. The schematic diagrams of the pulse power drivers are as shown at 200 and 240 in FIG. 2. The cathode diode for this example operates at approximately 150 kV, for example, and achieves a closing velocity of about 5 kilometers per second.

Figure 4:
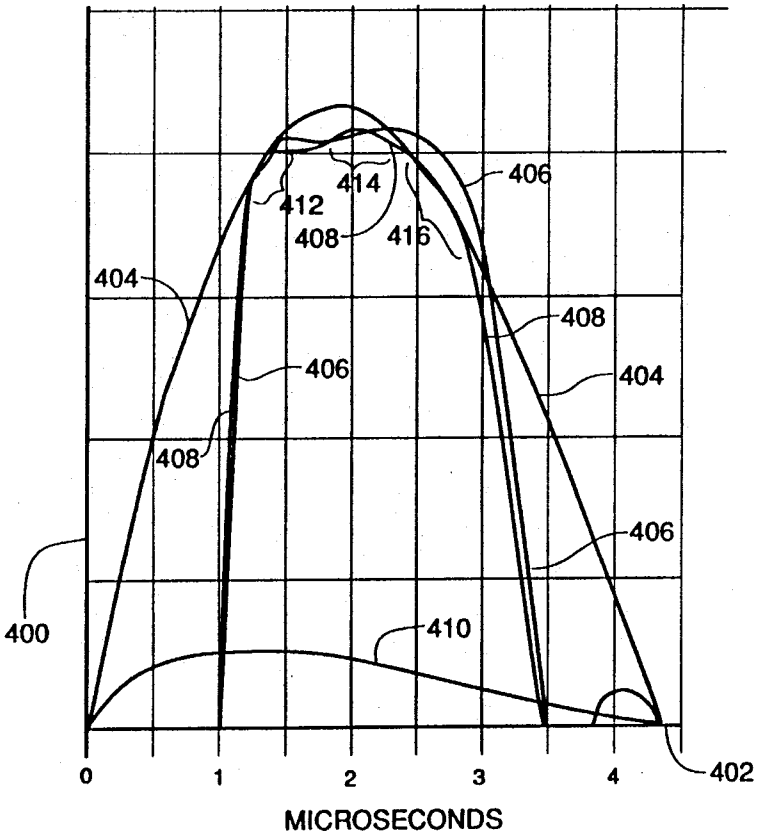
FIG. 4 shows a plurality of current and voltage waveforms describing operation of the FIG. 1 embodiment of the invention.

FIG. 4 shows the operational characteristics of both the cathode diode and the main diode for this example when configured according to the invention. In the FIG. 4 waveforms, the pulse 404 represents the cathode diode current and is measured against a vertical scale 400 having graduations of ten kiloamperes per division. In a similar manner, the main diode current is represented by the pulse 408. The pulses 406 and 410 in FIG. 4 represent the main diode voltage and the cathode diode voltages, respectively, and are measured against the vertical scale 400 with each division representing a voltage of one hundred twenty-five kilovolts. The repeated identification numbers shown in FIG. 4 are believed sufficient to identify the respective currents and voltages notwithstanding the overlapping of curves in the regions 412, 414, and 416.

The main diode source 200 in FIG. 2 is in fact preferably provided with a pulse delay of 0.5 microseconds in order to center the FIG. 4 main diode current pulse over the center of the current output pulse 404 of the cathode diode. This delay is achieved by synchronizing the switches S1 and S2, which are shown at 246 and 248 in the FIG. 2 circuit. It is notable that the main diode current waveform 408 is not of the same shape as the cathode diode current waveform 404 in FIG. 4. This occurs because the main diode current may be less than the cathode diode current, but may never exceed it. The main diode current 408 does not peak coincident with the cathode diode current 404 because of a space charge limitation in the main diode in this region. This space charge limitation helps shape the main diode current 408 to a more rectangular shape in this particular example.

It is significant to note that the voltage and current pulses 406 and 408 of the main diode are well formed in FIG. 4 as rectangular pulses, in sharp contrast to the waveforms in FIG. 3, which are distorted by the closing effects of the conventional explosive plasma cathode In addition to this waveform improvement, there is zero closing between the cathode and anode of the main diode when using the invention, compared to a 50% or 0.025 meter closing in the main diode not employing the invention.

EXAMPLE 2

The invention has heretofore been described in the configuration of a parallel plane diode. The described principles may however, be used to implement the invention in other diode geometries in which segregation of the explosive plasma cathode into a cathode diode compartment which provides current to the main diode compartment is used. The explosive plasma cathode and its attendant problems with closing are thereby isolated from the main diode. The main diode may then be operated to any desired high voltage level without incurring closing problems.

Figure 5:
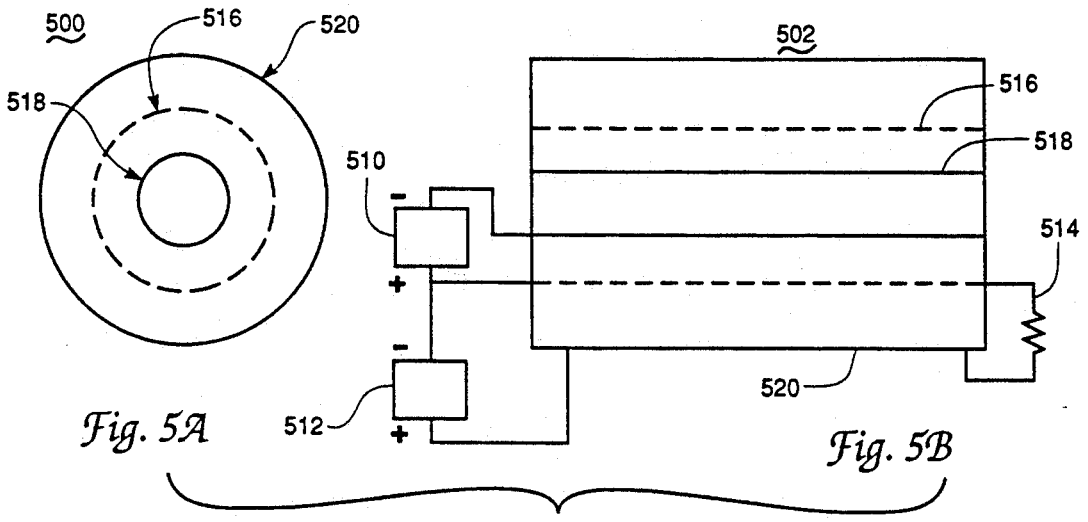
FIG. 5, which includes the views of FIG. 5A and FIG. 5B, shows an alternate physical arrangement of the invention.

An example of a coaxial configuration of the invention is shown at 500 and 502 in the endwise and lateral views of FIGS. 5A and 5B in FIG. 5. The plasma material in the FIG. 5 arrangement of the invention is located at the innermost cylinder 518. The screen electrode 516 is the next cylinder in FIG. 5 and the outer cylinder 520 is the anode electrode of the main diode. The blocks 510 and 512 in FIG. 5 represent the cathode diode and main diode energy sources, respectively, and the resistor 514 represents a radio frequency load that is driven by this transmission line configuration of the invention.

The FIG. 5 configuration of the invention is suitable for implementation of devices which are based upon the concept of magnetic insulation. The simplest such device is the magnetically insulated transmission line, (MITL or MIT Line) used for transmission of very high power levels of energy. The FIG. 5 apparatus may represent, for example, a segment of a MITL device. The diode action achieved by way of the present invention provides the characteristics of magnetic insulation without the deletion limitation of closing in contrast with a normal MITL device of FIG. 5.

EXAMPLE 3

Figure 6:
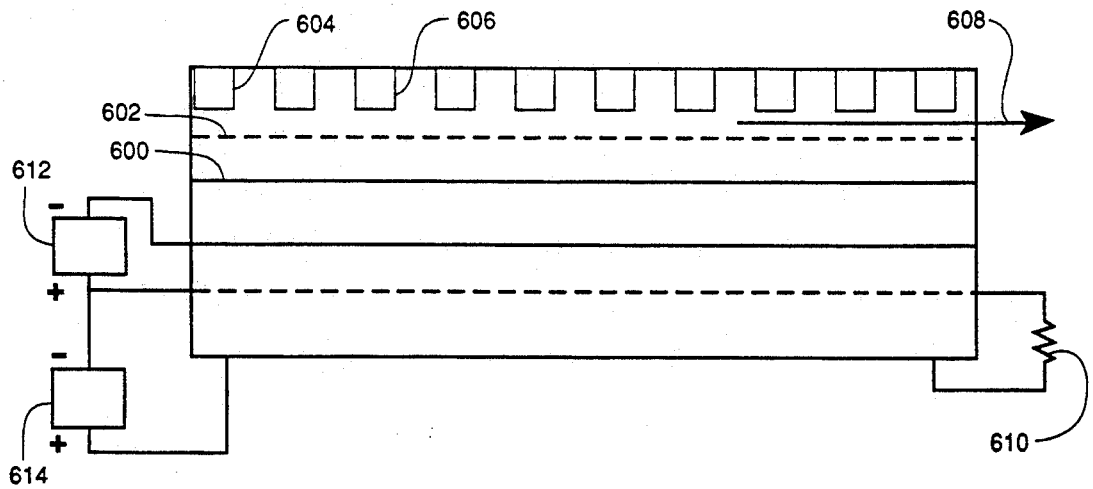
FIG. 6 shows another alternate physical arrangement of the invention.

FIG. 6 in the drawings shows another coaxial arrangement of the invention, an arrangement which functions as a Magnetically Insulated Line Oscillator that is useful for generating microwave spectrum radio frequency energy. In the FIG. 6 apparatus the cathode source of plasma is shown at 600, the screen electrode at and the main diode anode is represented by the annular rings 604, 606 etc. which are disposed in the form of a slow wave structure. The radio frequency load and characteristic impedance termination are represented by the resistor 610 in the FIG. 6 apparatus. The arrow 608 represents the microwave spectrum output energy of the FIG. 6 embodiment of the invention and the blocks and 614 represent the cathode diode and main diode energy sources. These sources may also be of the FIG. 2 pulse forming network type. In the FIG. 6 arrangement of the invention, the slow wave annular rings are required for the functioning of the oscillation action and generation of the microwave power, with respect to the more basic arrangement of the invention shown in FIG. 5.

The present invention therefore extends the useful operating time of an explosive plasma cathode excited device. This extension is accomplished by recognizing that the operating time in such devices is determined by plasma closure effects. Since plasma closure velocity increases with operating voltage, attempted device operation at higher voltages also results in faster closure time and shorter device output useful pulse width. The invention, however, permits device operation at an arbitrarily high voltage without closure effects by separating the using device into source and utilization diodes wherein the closure effect is absent from the utilization diode and confined to the source diode where such provisions as moderate operating voltages can be used to limit closure effect influences.

While the apparatus nd method herein described constitute a preferred embodiment of the invention, it is to be understood that the invention is not limited to this precise form of apparatus or method ad that changes may be made therein without departing from the scope of the invention which is defined in the appended claims.

I claim:

1. A method for segregating generation and use of charged plasma particles in a pulsed beam device to achieve increased charged particle operating cycle lifetime, said method comprising the steps of:

generating a positive charged particle and negative charged particle plasma in a particle generator portion of an evacuated enclosure;

accelerating selected of said charged plasma particles toward a particle transparent first electrode member in a plasma closing velocity responsive portion of said evacuated enclosure;

attracting particles, of said selected particles passing through said first electrode member, toward a particle collecting second electrode member in a closing velocity-immune, use portion of said evacuated enclosure.

2. The method of claim 1 wherein said generating step includes liberating a charged plasma at a cathode electrode surface, wherein said selected of said charged plasma particles are electrons, and wherein said accelerating and attracting steps first and second electrode members are each electron attracting anode members.

3. The method of claim 2 wherein said generating step includes subjecting a predetermined surface material of said cathode member to an electric field intensity in the explosive field emission intensity range.

4. The method of claim 3 wherein said generating and accelerating steps are accomplished in the same cathode inclusive portion of said evacuated enclosure.

5. The method of claim 4 further including the step of transiently elevating said first electrode anode number to a first positive operating potential and disposing said second electrode anode member at a second more positive operating potential.

6. The method of claim 5 wherein said first operating potential is above one hundred kilovolts.

7. The method of claim 6 further including the steps of generating said first and second positive operating potentials in a lumped inductive and capacitive element pulse forming delay line network.

8. The method of claim 7 wherein said second operating potential is above said first operating potential.

9. The method of claim 8 wherein said generating step includes plasma generation at said cathode material at current densities in excess of fifty amperes per square centimeter of cathode material surface.

10. The method of claim 9 wherein said generating, accelerating, and attracting steps in combination comprise an operating power level above one-half gigawatt.

11. The method of claim 10 wherein said attracting step selected particles are electron components of said plasma, and said electron components arrive at said first electrode member prior to positively charged ion particle components of said plasma and also wherein said attracting step includes thermally cooling said ion particles in said first electrode member.

12. The method of claim 11 further including the step of imparting a velocity between three and thirty kilometers per second to said generated plasma.

13. High current pulsed beam apparatus of tenths to tens of microseconds operating cycle duration comprising the combination of:

an evacuated enclosure having first and second chamber portions;

means including an emissive material surfaced first electrode member located in said evacuated enclosure first chamber portion for generating a plasma of positive and negative charges in said first chamber portion of said evacuated enclosure;

means, including screen-like, negative charges transparent second electrode member, disposed opposite to said first electrode member in said evacuated enclosure, and a first source of accelerating potential therefore for accelerating negative charge portions of said plasma away from said first electrode member and toward and through said second electrode member in a closing velocity effect susceptable first acceleration event;

means including a charge collecting third electrode member disposed opposite to said second electrode member in said second chamber portion of said evacuated enclosure and a second source of operating potential therefore for accelerating said negative charge portions passing through said second electrode member toward said third electrode member in a closing velocity effect immune second acceleration event;

said selected charge transparent second electrode member being disposed intermediate between said first and second chamber portions of said evacuated enclosure and enabling communication of vacuum and said selected negative charges therethrough.

14. The apparatus of claim 13 wherein said negative charges are electrons and wherein said first electrode is a cathode member and said second and third electrodes are anode members having positive electrical operating potentials with respect to said cathode member.

15. The apparatus of claim 14 wherein said cathode member is an explosive plasma field emission effect cathode.

16. The apparatus of claim 15 wherein said emissive material is comprised of a material taken from the group of a. graphite
b. carbon felt
c. carbonized textile cloth
d. impregnated metallic sponge.

17. The apparatus of claim 14 further including transient energy source means for energizing said second and third electrode anodes with positive voltage potentials.

18. The apparatus of claim 17 wherein said energy source means includes a lumped inductive and lumped capacitive pulse forming network for each of said anodes.

19. The apparatus of claim 14 wherein said second and third anode electrodes are disposed coaxially with respect to said first electrode cathode member.

* * * * *

UNITED STATES PATENT AND TRADEMARK OFFICE

CERTIFICATE OF CORRECTION

PATENT NO. : 5,302,881

DATED : April 12, 1994

INVENTOR(S) : James P. O'Loughlin

It is certified that error appears in the above-identified patent and that said Letters Patent is hereby corrected as shown below:

Title page, item [57],
Abstract, line 7, "in" should be deleted.

Column 6, line 10, "diode," should be --diode 114--.
Column 8, line 59, a period should follow "cathode".
Column 9, line 41, --602-- should precede "and".
Column 9, line 48, --612-- should follow "blocks".
Column 10, line 3, "nd" should be --and--.
Column 10, line 6, "ad" should be --and--.
Column 11, line 15, --a-- should follow "including".
Column 11, line 19, "therefore" should be --therefor--.

Signed and Sealed this

Thirtieth Day of May, 1995

Bruce Lehman

*Attest:*

*Attesting Officer*

BRUCE LEHMAN

*Commissioner of Patents and Trademarks*